US008033059B2

(12) United States Patent
Contois et al.

(10) Patent No.: US 8,033,059 B2
(45) Date of Patent: Oct. 11, 2011

(54) PANELING SYSTEM

(75) Inventors: James Contois, Davenport, IA (US); Robert K. Nichols, Muscatine, IA (US); Teresa Falck, Muscatine, IA (US); Gregory Ferris, Muscatine, IA (US); Matthew C. Brown, Wilton, IA (US); Ronald Hartman, Wilton, IA (US); Mark Roumfort, Muscatine, IA (US); Christopher J. Mefford, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 1068 days.

(21) Appl. No.: 11/761,311

(22) Filed: Jun. 11, 2007

(65) Prior Publication Data

US 2007/0284062 A1 Dec. 13, 2007

Related U.S. Application Data

(60) Provisional application No. 60/804,340, filed on Jun. 9, 2006.

(51) Int. Cl.
*E04B 2/78* (2006.01)
*E04B 2/74* (2006.01)

(52) U.S. Cl. ..... 52/36.6; 52/36.4; 52/239; 52/764; 160/135; 160/351

(58) Field of Classification Search ..... 52/36.4, 52/36.5, 36.6, 238.1, 239, 241, 481.2, 762, 52/764, 775, 281, 282.1, 282.4, 285.1; 160/135, 160/351

See application file for complete search history.

(56) References Cited

U.S. PATENT DOCUMENTS

| | | | | | |
|---|---|---|---|---|---|
| 3,047,061 | A | * | 7/1962 | Wilcox et al. | 160/351 |
| 3,327,440 | A | * | 6/1967 | Watkins | 52/239 |
| 3,398,981 | A | * | 8/1968 | Vincens | 403/388 |
| 3,605,851 | A | * | 9/1971 | Miles et al. | 160/135 |
| 3,788,378 | A | * | 1/1974 | Sobel | 160/135 |
| 3,809,142 | A | * | 5/1974 | Bleeker | 160/135 |
| 3,817,396 | A | * | 6/1974 | Markson | 211/198 |
| 3,871,144 | A | * | 3/1975 | Rudin | 52/36.5 |
| 3,908,320 | A | * | 9/1975 | Hogue | 52/36.5 |
| 3,971,182 | A | * | 7/1976 | Donahue et al. | 52/282.3 |
| 4,104,838 | A | * | 8/1978 | Hage et al. | 52/239 |
| 4,434,900 | A | * | 3/1984 | Cook | 211/189 |
| 4,601,137 | A | * | 7/1986 | Bates | 52/63 |
| 4,637,178 | A | * | 1/1987 | Nimmo et al. | 52/36.4 |
| 4,833,848 | A | * | 5/1989 | Guerin | 52/242 |
| 4,956,953 | A | * | 9/1990 | Bates | 52/239 |
| 5,069,263 | A | * | 12/1991 | Edwards | 160/135 |
| 5,155,955 | A | | 10/1992 | Ball et al. | |
| 5,309,686 | A | * | 5/1994 | Underwood et al. | 52/29 |
| 5,428,928 | A | * | 7/1995 | Hellwig et al. | 52/239 |
| 5,560,418 | A | | 10/1996 | Kissinger | |
| 5,806,258 | A | * | 9/1998 | Miedema et al. | 52/220.7 |
| 5,890,325 | A | | 4/1999 | Corcorran et al. | |
| 5,970,662 | A | | 10/1999 | Corcorran et al. | |
| 5,979,118 | A | | 11/1999 | Gortsema et al. | |
| 6,021,613 | A | | 2/2000 | Reuter et al. | |
| 6,052,958 | A | * | 4/2000 | Miedema et al. | 52/284 |

(Continued)

*Primary Examiner* — Robert Canfield
(74) *Attorney, Agent, or Firm* — Faegre & Benson LLP

(57) ABSTRACT

A paneling system for use as a wing and/or return panel for dividing large open office areas into smaller work stations. The paneling system includes a frame having top and bottom surfaces, and side surfaces. Attachment assemblies are used for removably attaching one or more paneling system to one or more of a spine wall, post, wing panel, return panel, and work surfaces.

40 Claims, 10 Drawing Sheets

U.S. PATENT DOCUMENTS 6,076,317 A * 6/2000 Hellwig et al. ..... 52/239
6,134,845 A * 10/2000 Shipman et al. ..... 52/36.4
6,148,567 A 11/2000 DeRuiter et al.
6,173,543 B1 1/2001 Gortsema et al.
6,230,459 B1 * 5/2001 Jeffers et al. ..... 52/239
6,282,854 B1 * 9/2001 Vos et al. ..... 52/239
6,378,255 B1 4/2002 Eich et al.
6,397,532 B1 * 6/2002 Shipman et al. ..... 52/220.7
6,418,671 B1 7/2002 DeRuiter et al.
6,520,357 B1 * 2/2003 Kautz et al. ..... 211/191
6,557,310 B2 5/2003 Marshall et al.
6,651,396 B2 11/2003 DeRuiter et al.
6,742,307 B2 6/2004 Briskman
7,150,127 B2 * 12/2006 Underwood et al. ..... 52/36.1
7,603,821 B2 * 10/2009 Eberlein et al. ..... 52/239
2002/0017066 A1 2/2002 Marshall et al.
2002/0148179 A1 10/2002 DeRuiter et al.
2003/0115818 A1 * 6/2003 Weurman ..... 52/481.2
2003/0150180 A1 8/2003 Briskman
2003/0213193 A1 11/2003 Carroll et al.
2003/0221384 A1 12/2003 Burken et al.
2004/0113530 A1 6/2004 Anderson
2004/0187401 A1 9/2004 Krestakos et al.
2006/0059806 A1 3/2006 Gosling et al.

* cited by examiner

PANELING SYSTEM

CROSS-REFERENCE TO RELATED APPLICATION(S)

This application claims the benefit of U.S. Provisional Patent Application Ser. No. 60/804,340 filed Jun. 9, 2006, titled "Panel System," the entirety of which is hereby incorporated by reference.

TECHNICAL FIELD

The present invention relates to office furniture. More specifically, the invention is a paneling systems used as a workspace divider.

BACKGROUND

Commercial buildings typically include large open office areas which are divided into smaller workstations by any of a number of wall paneling systems. These paneling systems typically include upright space dividing wall panels that are typically less than floor-to-ceiling height, and cooperate with other furniture components to define an equipped workstation.

One space dividing wall panel system is the "spine" wall system. The spine wall typically runs the length of a group of workstations, and supports space dividing "wing" panels on opposite sides of the spine wall to define individual workstations. Spine walls include significant cabling capacity so as to allow communications and power cabling to be laid within and along the length of the spine wall. Typical spine walls also provide an increased load bearing capacity for readily mounting and supporting thereon furniture components such as work surfaces, file cabinets, shelf units and the like.

While the wing panels may be formed from the same wall panels as the spine wall, the ever changing needs and requirements of an office environment necessitates the need for a paneling system that is easily moveable with minimal amount of labor. In most instances, the functionalities and features of a spine wall, such as the power and communications cables, render it undesirable for use as a wing panel because of the difficulties associated with re-routing the cabling system, including inconveniences such as loss of power and communications for workstations that are not being reconfigured. Therefore, there exists a need for a wall paneling system which does not include all the functionalities and features provided by a spine wall, and therefore also less costly. The paneling system must be amenable to being easily moved with the least amount of labor, and also such that workstations can be quickly reconfigured.

SUMMARY

A paneling system in accordance with an embodiment of the invention is a de-featured spine wall, such as a spine wall without power and communications cables and without load-bearing capabilities. The paneling system includes a frame, the frame having a top and a bottom surface, and a first and a second side surface. Attachment assemblies removably secure a first post to the first side surface and a second post to the second side surface.

In an embodiment of the invention, one of the two posts is a connector on a spine wall where-through the paneling system is attached to the spine wall, and the other post is an end post extending from the top surface of the panel. The top surface of the frame includes a topcap, and the bottom surface includes a beltline tube. The beltline tube, as is well known in the art, includes at least one attachment channel. At least one work surface bracket is removably engaged in the at least one attachment channel, and a work surface is fixedly secured to the work surface bracket. In such configurations, the paneling system is typically referred to in the art as the "wing" panel or wall.

In accordance with another embodiment of the invention, two substantially similar first and second paneling systems are attached to one another. The topcap of the second paneling system includes at least one groove wherein removably engaged is a top bracket fixedly secured to the end post of the first paneling system. Additionally, the at least one attachment channel in the beltline tube of the second paneling system includes a bottom bracket removably engaged therein. The bottom bracket is also fixedly secured on the same side of the post to which the top bracket it secured. In such configurations, the first and the second paneling systems are typically referred to in the art as the "wing" panel or wall and the "return" panel or wall, respectively.

DETAILED DESCRIPTION

While multiple embodiments of the instant invention are disclosed, still other embodiments may become apparent to those skilled in the art. The following detailed description shows and describes only illustrative embodiments of the invention. It should be clearly evident that there is no intent to limit the invention in any form or manner. As such, all alternative embodiments of the invention are within the spirit, scope, and intent of the disclosed invention.

Figure 1:
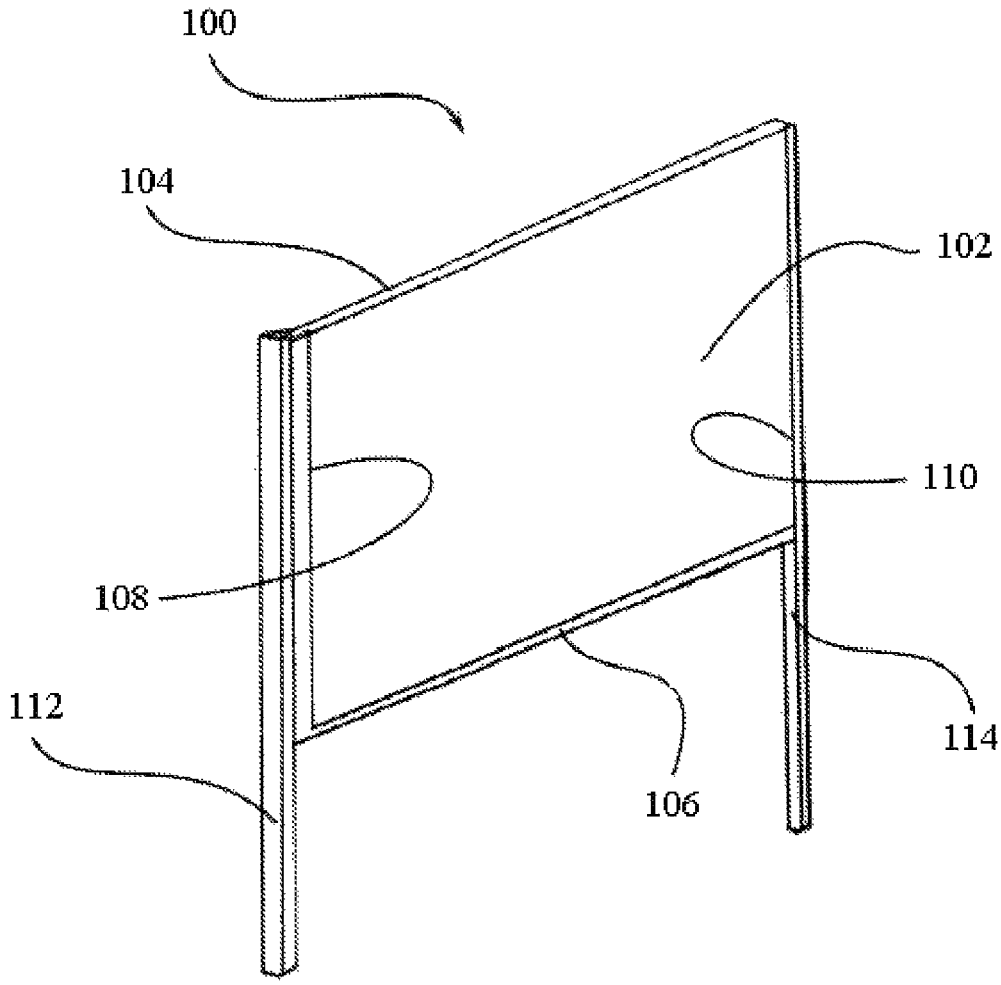
FIG. 1 is a perspective view of a paneling system in accordance with an embodiment of the invention.

FIG. 1 is a perspective view of paneling system 100. An embodiment of the paneling system includes a frame having a top surface, a bottom surface, a first side surface, and a second side surface, wherein the frame is removably attached to a first and a second post. In FIG. 1, paneling system 100 is shown including frame 102 having top surface 104, bottom surface 106, first side surface 108, and second side surface 110. An attachment assembly (not shown) removably attaches first side surface 108 to first post 112. Similarly, another attachment assembly (also not shown) removably attaches second side surface 110 to second post 114. As shown, first and second posts 112 and 114, respectively, span along first and second side surfaces 108 and 110, extending from top surface 104, beyond bottom surface 106, and to the support system (not shown) for paneling system 100.

Figure 2:
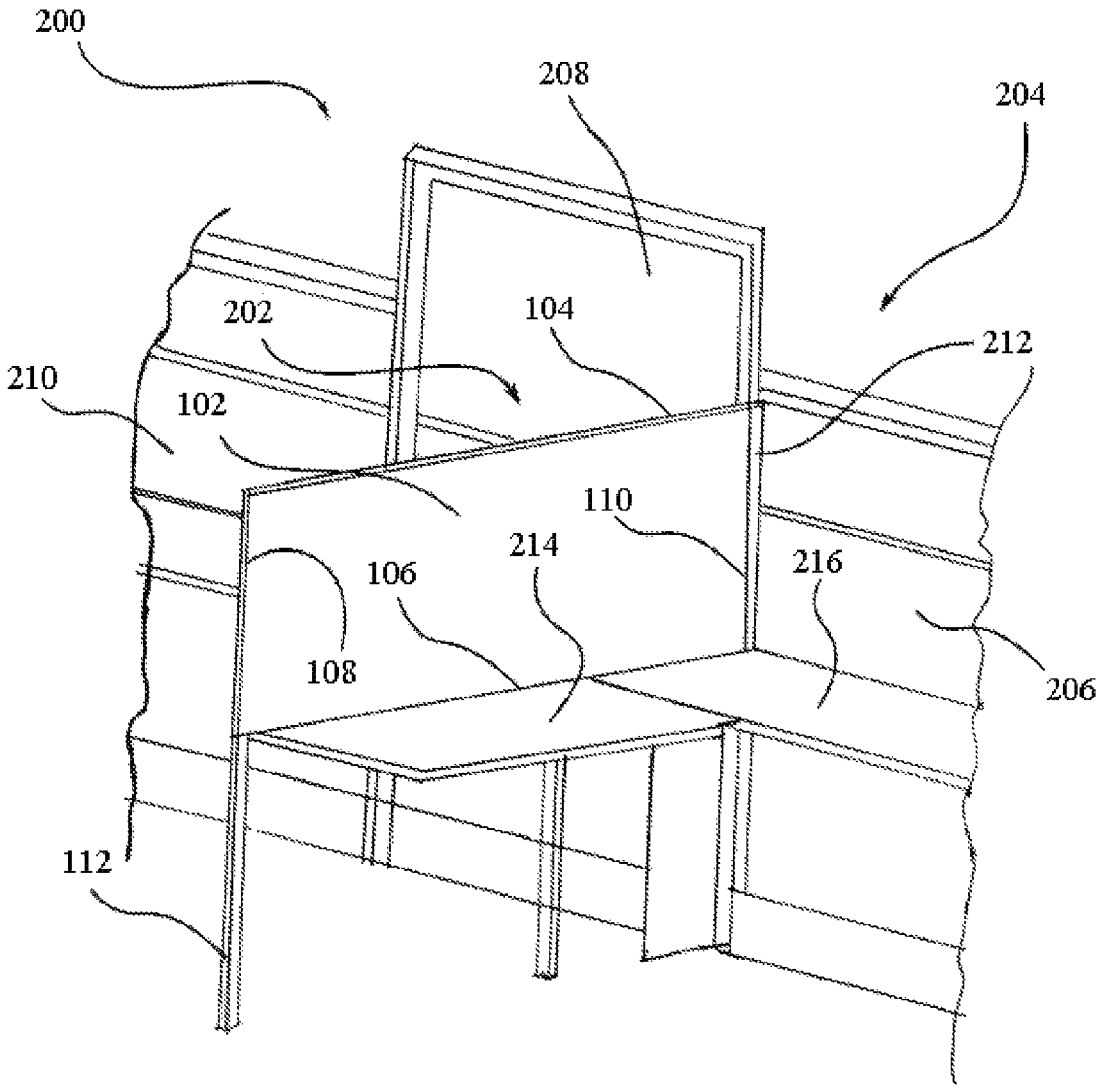
FIG. 2 is a perspective view of a paneling system attached to a spine wall.

FIG. 2 is a perspective view of wall 200 having paneling system 202 removably attached to spine wall 204. In an alternate embodiment, wall 200 includes paneling system 202 slidable engaged to spine wall 204. An embodiment of paneling system includes a frame having a top surface, a bottom surface, a first side surface, and a second side surface, wherein the frame is removably attached to a first and a second post. In FIG. 2, paneling system 202, in the form of a "wing" panel or wall, is shown including frame 102 having top surface 104, bottom surface 106, first side surface 108, and second side surface 110. An attachment assembly (not shown) removably attaches first side surface 108 to first post 112. Similarly, another attachment assembly (also not shown) removably attaches second side surface 110 to connector 212 on spine wall 204. As shown, first post 112 spans along side surface 108, extending from top surface 104, beyond bottom surface 106, and to the support system (not shown) for wall 200. Spine wall 204 is shown having spine panels 206, 208 and 210, and connector 212. Work surface brackets (not shown) are typically used for attaching work surface 214 to paneling system 202 along bottom surface 106 of frame 102, and for attaching work surface 216 to spine panel 206 of spine wall 204.

Spine wall 204 is a dividing wall typically running the length of a group of workstations. Dividers used for defining individual workstations, such as paneling system 202, are supported by posts, such as post 112, and by removable attachment and/or slidable engagement to opposite sides of spine wall 204. Spine wall 204, as is well known in the art, includes significant cabling capacity so as to allow communications and power cabling to be laid within the wall structure. Typical spine walls also include load bearing capabilities for readily mounting and supporting thereon furniture components such as work surfaces, file cabinets, shelf units and the like.

Figure 3A:
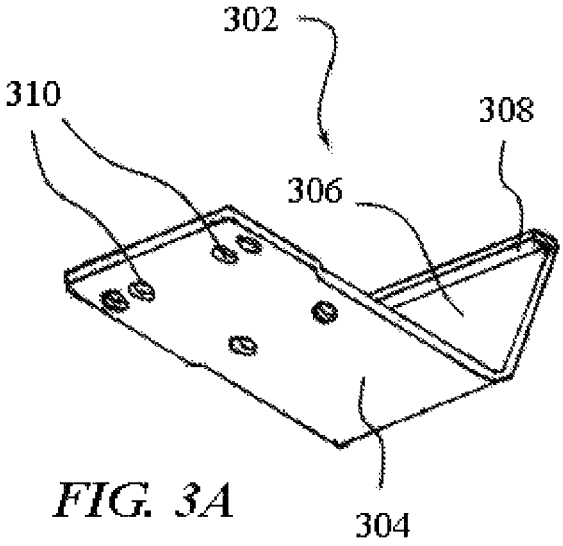
FIG. 3A is a perspective view of a work surface bracket in accordance with an embodiment of the invention.
Figure 3B:
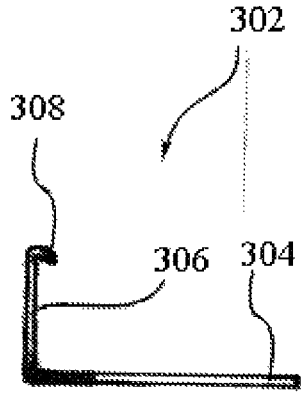
FIG. 3B is a side view of the work surface bracket shown in FIG. 3A

FIG. 3A is a perspective view and FIG. 3B is an end view of work surface bracket 302 in accordance with an embodiment of the invention. Work surface bracket 302 is generally "L"-shaped having surface 304 with surface 306 extending out of the plane of surface 304. Surface 306 includes hook 308 at the end opposite surface 304. Surface 304 includes a plurality of holes 310 wherethrough fastening means such as screws are used for fixedly securing a work surface to work surface bracket 302.

Figure 3C:
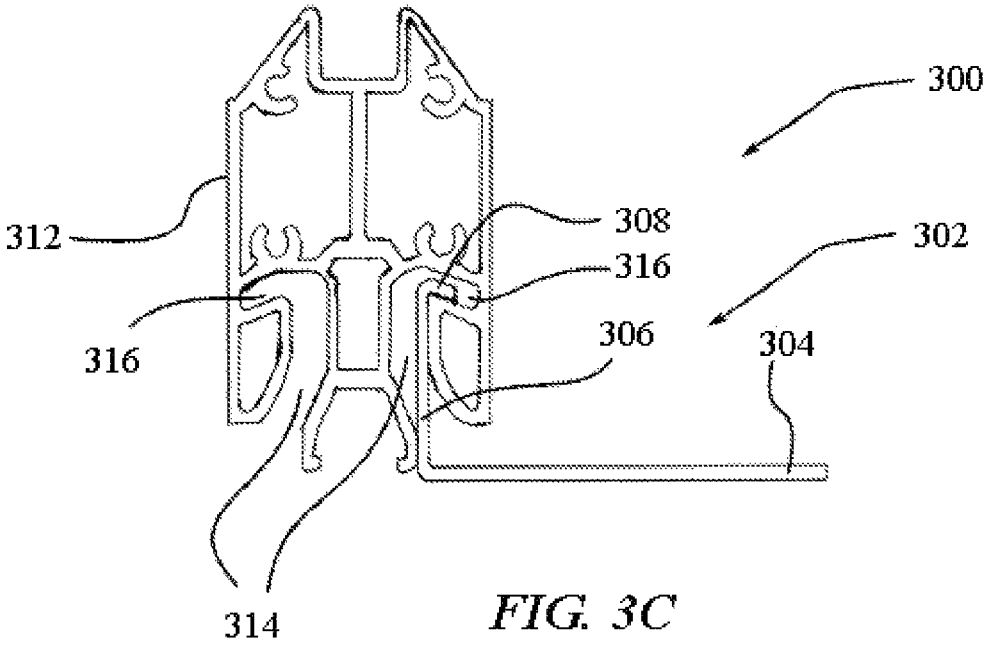
FIG. 3C is a cross-sectional view of a beltline tube with the work surface bracket of FIG. 3A engaged therein.

FIG. 3C is a cross-sectional view of assembly 300 showing work surface bracket 302 installed in beltline tube 312 in accordance with an embodiment of the invention. Beltline tube 312 is shown having two generally "C"-shaped attachment channels 314 having grooves 316 for removably housing and engaging work surface bracket 302. Surface 306 and hook 308 are housed within one attachment channel 314, and positioned such that hook 308 securely engages into groove 316 of attachment channel 314. A work surface (not shown) is securely attached atop surface 304. Although not shown, additional work surface brackets 302 are removably attached to beltline tube 312 on the same side as work surface bracket 302 and/or on the side opposite the side having work surface bracket 302.

Figure 4:
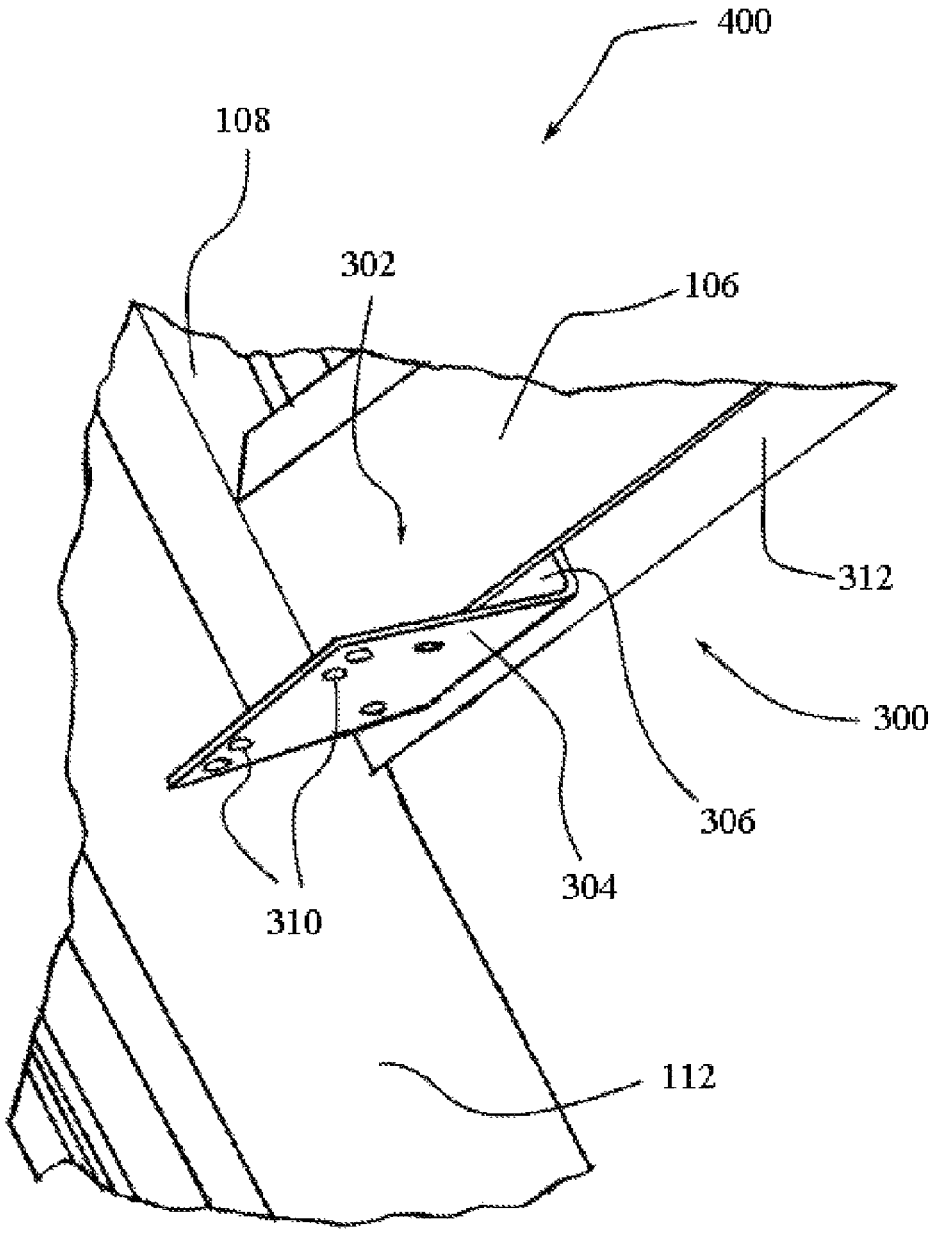
FIG. 4 is a perspective view showing a work surface bracket installed in a beltline tube.

FIG. 4 is a perspective view of work surface bracket 302 installed within beltline tube 312 spanning along bottom surface 106 of frame 102. As shown, surface 304 of work surface bracket 302 includes a plurality of holes 310 through which a work surface (not shown) placed atop surface 304 is secured with fastening means such as screws. At least one attachment channel 314 spans a substantial length of beltline tube 312 thereby providing the flexibility of locating one or more work surface brackets 302 anywhere along bottom surface 106. In accordance with an embodiment of the invention, at least two spaced apart work surface brackets 302 are removably engaged within the at least one attachment channel 314 of beltline tube 312. As such, work surfaces of different widths, shapes, and/or sizes can be attached to paneling system 202.

Figure 5:
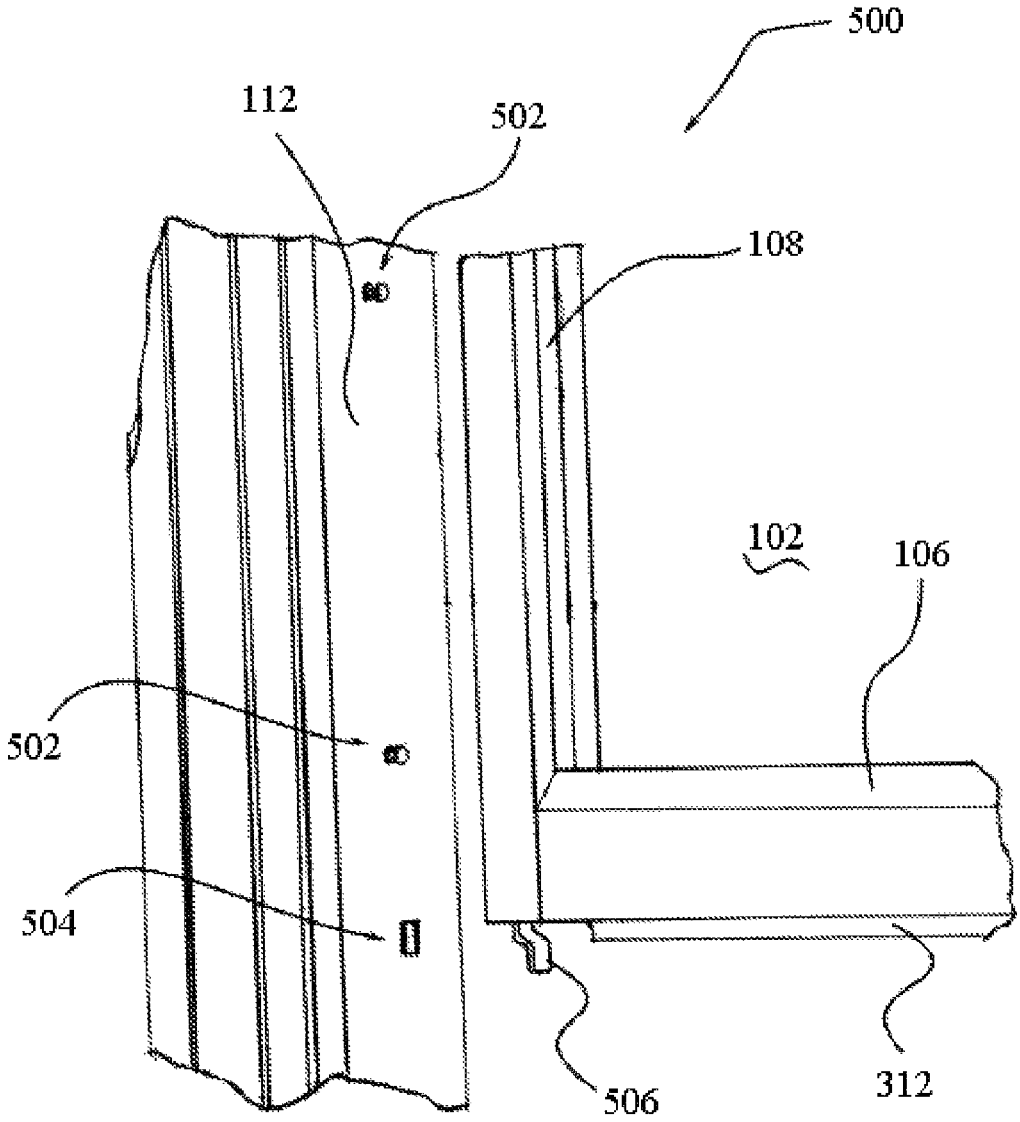
FIG. 5 is a partial perspective view of a disassembled attachment assembly in accordance with an embodiment of the invention.
Figure 6:
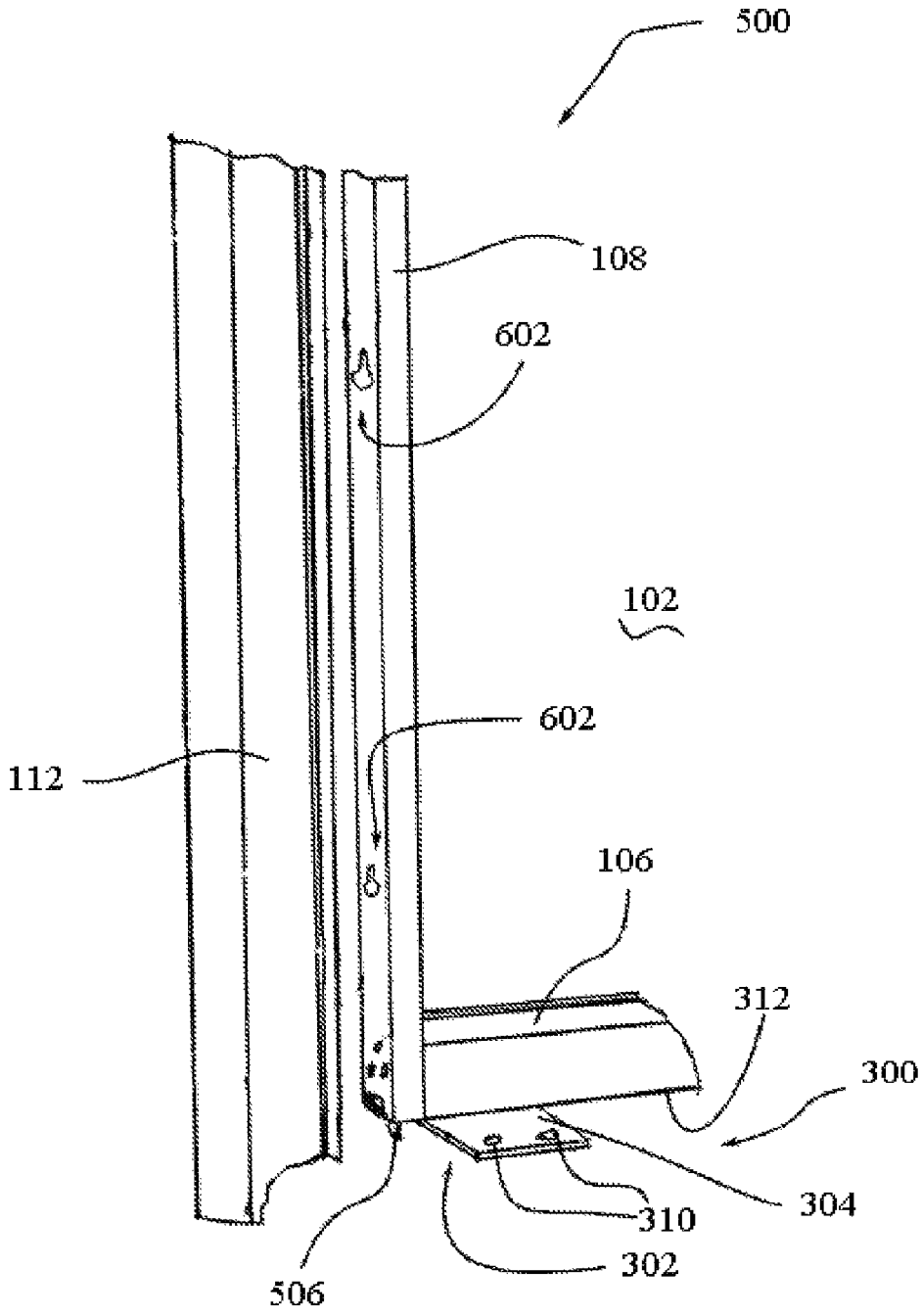
FIG. 6 is another partial perspective view showing the disassembled attachment assembly of FIG. 5.

FIGS. 5 and 6 are partial perspective views of the elements of an attachment assembly. An embodiment of the attachment assembly includes at least one matched pair of engagement components wherein one component engages the other component. Another embodiment of the attachment assembly, as illustrated in FIGS. 5 and 6 and as described in detail in the following, typically includes at least one matched combination of a shoulder bolt and a key-hole slot and at least one matched combination of an engagement clip and an engagement slot. As previously discussed, the at least one attachment assembly removably attaches a side surface of frame 102 to at least one other component such as post 112 or 114, connector 212, another paneling system, or another spine wall.

FIG. 5 is a partial perspective view of paneling system 500 showing a portion of an attachment assembly for removably attaching post 112 to side surface 108 of frame 102. Post 112 is shown as including at least two spaced apart shoulder bolts 502, and at least one engagement slot 504. Shoulder bolts 502 are configured for being received by and engaged in correspondingly aligned mating key-hole slots on side surface 108. The at least one engagement slot 504 is configured for mating with and receiving for engagement at least one correspondingly aligned engagement clip 506 on side surface 108. As shown, engagement clip 506 extends beyond the bottom plane of bottom surface 106 having beltline tube 312 therein.

FIG. 6 is a partial perspective view of paneling system 500 showing the remainder of the attachment corresponding to that shown in FIG. 5 for removably attaching post 112 to side surface 108 of frame 102. Side surface 108 is shown as including at least two spaced apart key-hole slots 602, and at least one engagement clip 506. Key-hole slots 602 are configured for receiving and engaging correspondingly aligned mating shoulder bolts 502 on post 112. The at least one engagement clip 506 is configured for being received for engagement in the at least one correspondingly aligned engagement slot 504 on post 112.

FIGS. 5 and 6 illustrate an embodiment of an attachment assembly having correspondingly aligned elements on side surface 108 of frame 102 and post 112 for removable engagement. Side surface 108 and post 112 are used solely for the purpose of discussion and illustration only. Posts 112 and 114 are equally interchangeable and as such either one can be attached to either one of the two side surfaces 108 and 110. Alternate embodiments of the invention include one of the two side surfaces removably attached to one of the two posts, with the other side surface removably attached to other wall components such as a connector, a spine wall, another paneling system, etc.

FIGS. 5 and 6 further illustrate an embodiment of an attachment assembly wherein shoulder bolts 502 and engagement slot 504 are on post 112, and the correspondingly aligned key-hole slots 602 and engagement clip 506 are on side surface 108. Again, such placement of the elements of the attachment assembly is solely for the purpose of discussion and illustration only. In one or more alternative embodiments (not shown), the shoulder bolts and the engagement slot are on the one or more side surface of the frame, and the correspondingly aligned key-hole slots and engagement clip are on the component such as the post, connector, spine wall, another paneling system, etc. In another embodiment (also not shown), an engagement element other than shoulder bolt 502 is used.

Figure 7:
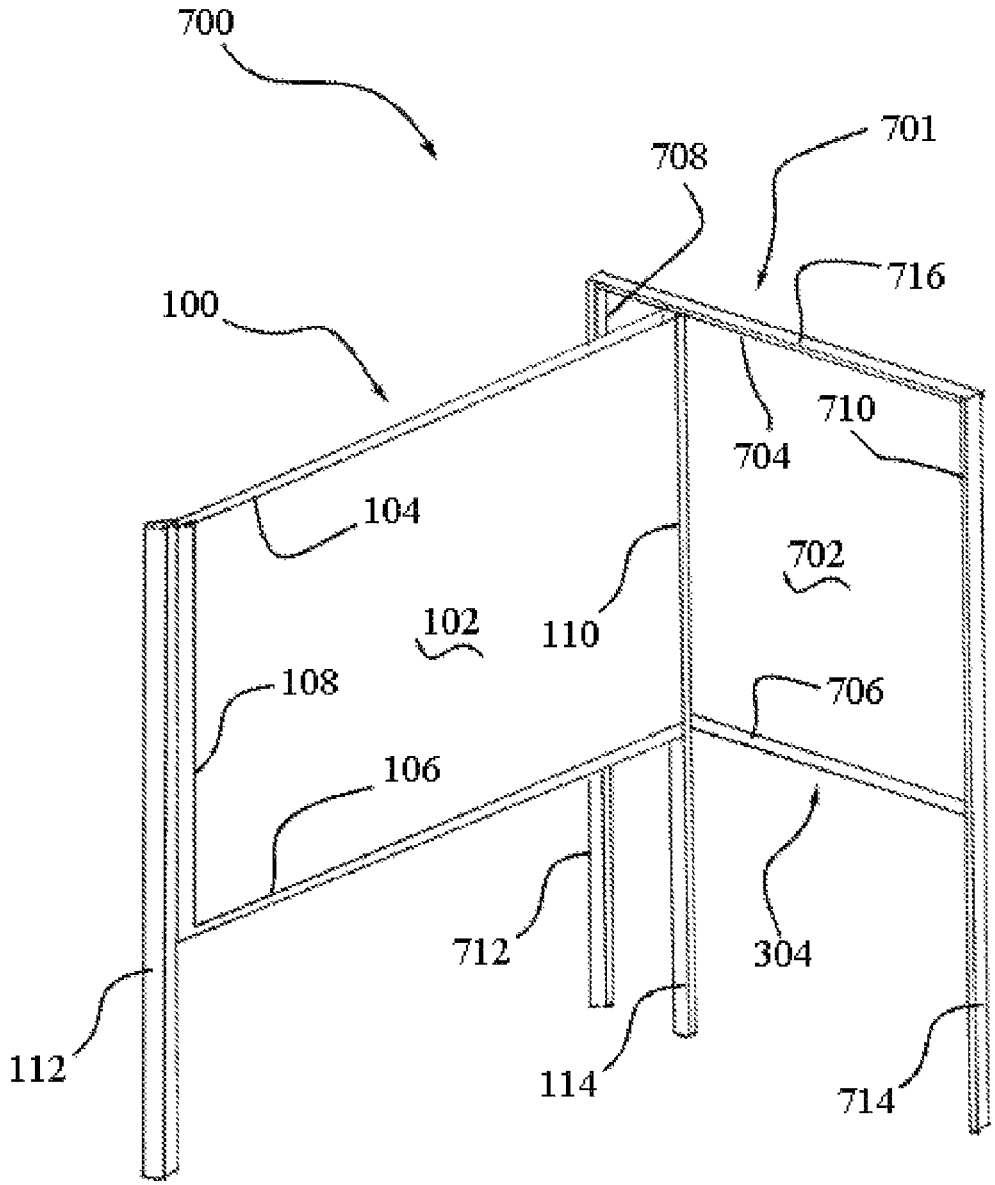
FIG. 7 is a perspective view of two paneling systems attached to one another in accordance with an embodiment of the invention.

FIG. 7 is a perspective view of wall system 700 in accordance with another embodiment of the invention. Wall system 700 includes paneling systems 100 and 701 removably attached at post 114 of paneling system 100. Paneling system 100 is substantially similar to that discussed in the foregoing in connection with FIG. 1. Paneling system 701 is substantially similar to paneling system 100, and includes frame 702 having top surface 704, bottom surface 706, and side surfaces 708 and 710. An attachment assembly, such as that discussed in the foregoing in connection with FIGS. 5 and 6, removably attaches side surface 708 to post 712. Similarly, another attachment assembly (not shown) removably attaches side surface 710 to post 714. As shown, posts 712 and 714, respectively, span side surfaces 708 and 710, extending from top surface 704, beyond bottom surface 706, and to the support system for wall system 700. Frame 702 includes topcap 716 along top surface 704, and beltline tube 304 along bottom surface 706. In one or more alternative embodiments (not shown), frame 102 also includes beltline tube 304 along bottom surface 106. In other embodiments (also not shown), paneling system 100 includes one or more work surface assemblies having at least one work surface bracket removably attached to the beltline tube along bottom surface 106. In still other embodiments (not shown), one or more work surfaces are fixedly secured with fastening means such as screws to the at least one work surface bracket. In one such embodiment, the work surface assembly is similar to work surface assembly 300 discussed in the foregoing in connection with FIG. 3.

The embodiment of wall system 700 shown in FIG. 7 is illustrated as being substantially self-supporting with posts 112 and 114 on paneling system 100, and posts 712 and 714 on paneling system 701. In one or more alternative embodiments (not shown), side surface 108 of paneling system 100 is removably attached and/or slidably engaged to a connector on a spine wall (not shown), and post 114 is removably attached to paneling system 701 as shown. In one such configuration (also not shown), paneling system 100 attached and/or engaged to the spine wall is typically referred to in the art as the "wing" panel or wall, and paneling system 701 attached to the wing panel at the end opposite the spine wall is typically referred to as the "return" panel or wall.

Figure 8A:
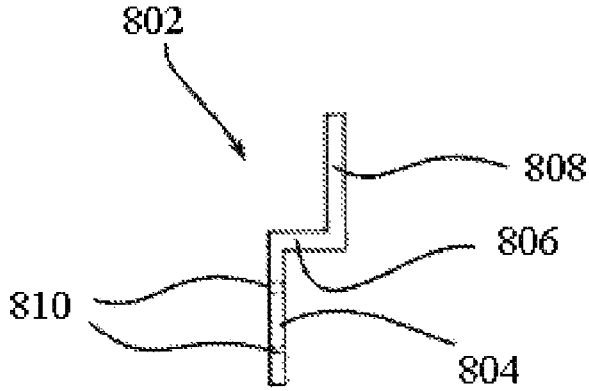
FIG. 8A is an end view of a top bracket in accordance with an embodiment of the invention.
Figure 8B:
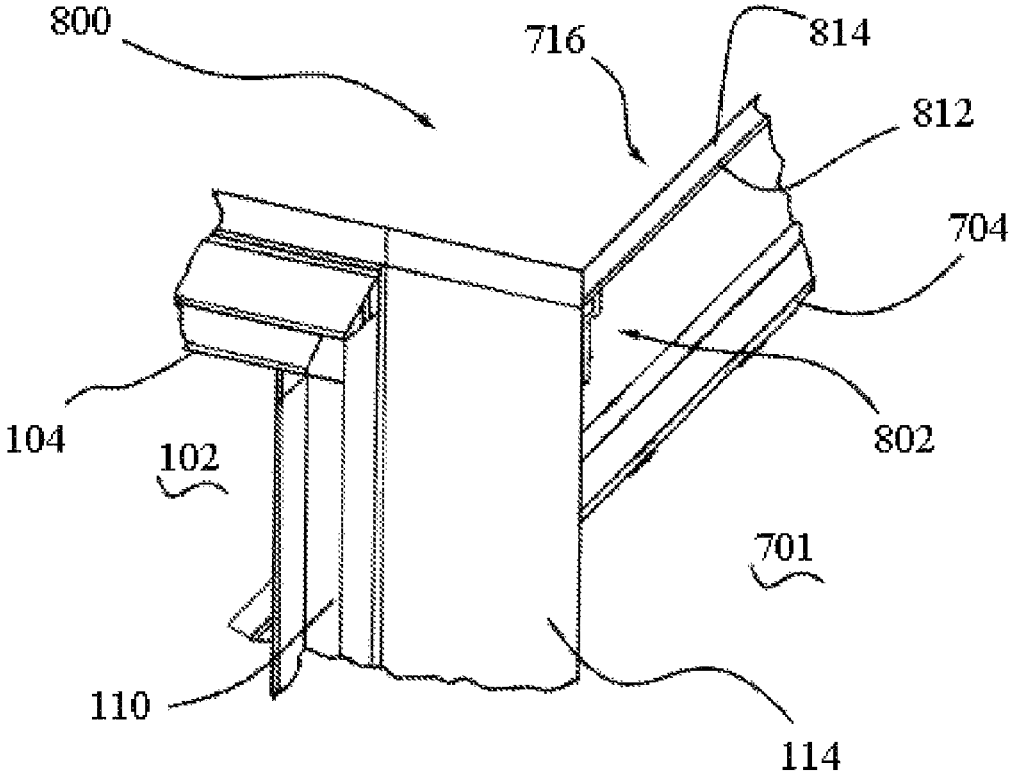
FIG. 8B is a partial perspective view of two paneling systems attached to one another with the top bracket of FIG. 8A.

FIG. 8A is an end view of top bracket 802 for removably attaching return panel 701 to wing panel 100, thereby forming wall system 800 of FIG. 8B in accordance with an embodiment of the invention. In accordance with another embodiment, the return panel and the wing panel are slidably engaged. Top bracket 802 includes surface 804 with surface 806 extending out of the plane of surface 804, and surface 808 extending out of the plane of surface 806 in a direction opposite surface 804. Surface 804 includes a plurality of holes 810 through which fastening means, such as screws, securely attach top bracket 802 to post 114. Surface 806 of top bracket 802 is positioned extending outwardly away from the plane of post 114. Topcap 716 along top surface 704 of paneling system 701 includes groove 812 under surface 814. Groove 812 is configured for removably engaging surface 808 of top bracket 802 such that paneling system 701 is attached to paneling system 100, i.e., the wing panel.

Figure 9A:
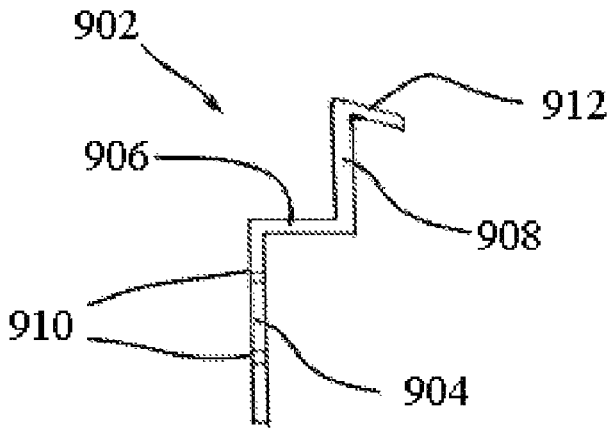
FIG. 9A is an end view of a bottom bracket in accordance with an embodiment of the invention.
Figure 9B:
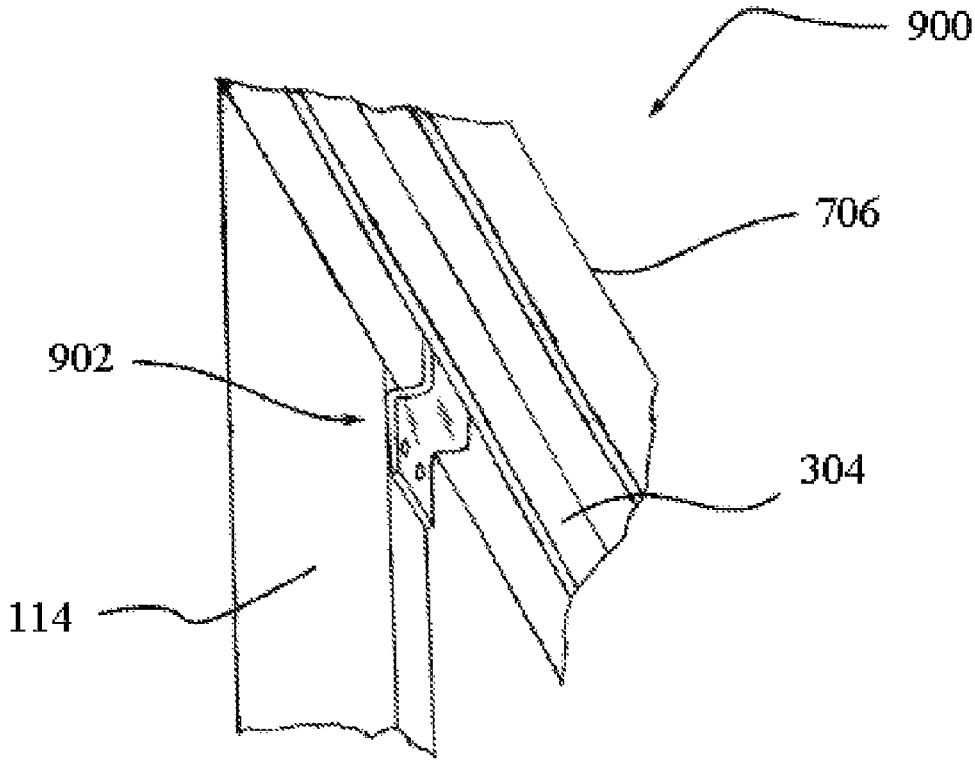
FIG. 9B is a partial perspective view of two paneling systems attached to one another with the bottom bracket of FIG. 9A.

FIG. 9A is an end view of bottom bracket 902 for removably attaching return panel 701 to wing panel 100, thereby forming wall system 900 of FIG. 9B in accordance with an embodiment of the invention. In accordance with another embodiment, the return panel and the wing panel are slidably engaged. Bottom bracket 902 includes surface 904 with surface 906 extending out of the plane of surface 904, and surface 908 extending out of the plane of surface 906 in a direction opposite surface 904. Surface 904 includes a plurality of holes 910, and surface 908 includes hook 912 at the end opposite surface 906. Surface 908 and hook 912 are substantially similar to surface 306 and hook 308 discussed previously in connection with FIG. 3. Surface 908 and hook 912 are housed within one attachment channel 314, and positioned such that hook 912 securely engages into groove 316 of attachment channel 314. Fastening means, such as screws, fixedly secure surface 904 of bottom bracket 902 to post 114 on the same side to which top bracket 802 is secured. Accordingly, bottom surface 706 of paneling system 701 is attached to post 114 of paneling system 100.

In reference to FIGS. 8A, 8B, 9A, and 9B, it will be obvious to one skilled in the art, that the return panel and the wing panel are slidably engaged to one another. Though not shown, the wing and/or the return panel can also similarly slidably engage the spine wall, other panels, alternate wall configuration, and other space dividers of various forms, shapes, and sizes.

As described above, surface 306 and hook 308 of work surface bracket 302 are substantially similar to surface 908 and hook 912 of bottom bracket 902. Such common design features permit the use of a single design for the beltline tube, thereby minimizing the requirement for additional parts resulting in cost savings.

Figure 10A:
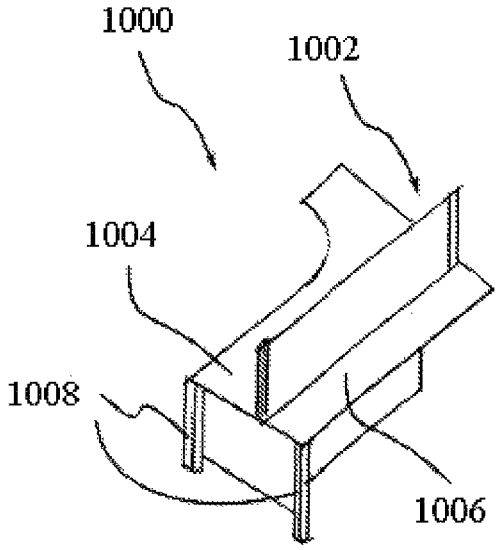
FIGS. 10A-10D are partial perspective views of different embodiments for work station configurations utilizing the paneling system of the invention.
Figure 10B:
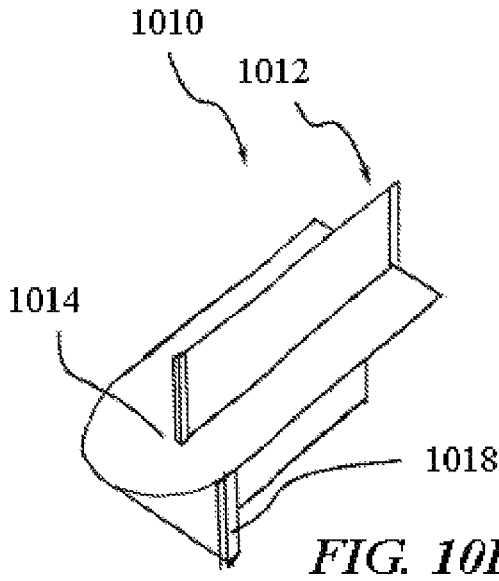
Figure 10C:
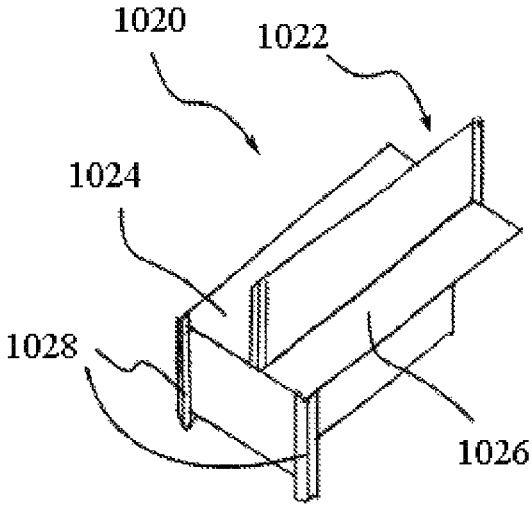
Figure 10D:
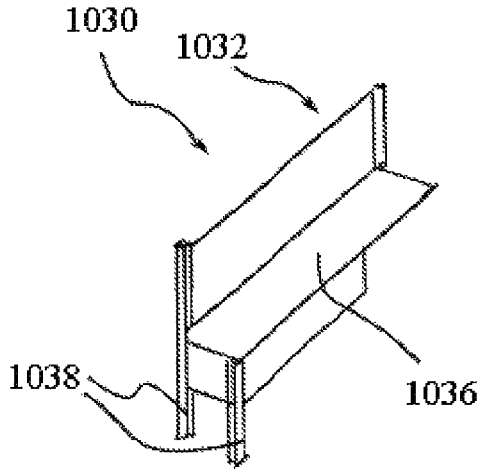

FIGS. 10A-10B are perspective views of different embodiments for work station configurations utilizing the paneling system of the invention. FIG. 10A illustrates work station 1000 having paneling system 1002 of an embodiment of the invention with work surfaces 1004 and 1006 extending from both sides of paneling system 1002. Work station 1000 includes at least two legs 1008 for supporting paneling system 1002 and work surfaces 1004 and 1006. FIG. 10B illustrates work station 1010 having paneling system 1012 of an embodiment of the invention with curved work surface 1014 extending around three sides of paneling system 1012. Work station 1010 includes at least one leg 1008 for supporting paneling system 1012 and work surface 1014. FIG. 10C illustrates work station 1020 having paneling system 1022 of an embodiment of the invention with work surfaces 1024 and 1026 extending from both sides of paneling system 1022. Work station 1020 includes at least two legs 1028 for supporting paneling system 1022 and work surfaces 1024 and 1026. FIG. 10D illustrates work station 1030 having paneling system 1032 of an embodiment of the invention with work surface 1036 extending from one side of paneling system 1032. Work station 1030 includes at least two legs 1038 for supporting paneling system 1032 and work surface 1036.

It should be obvious to one skilled in the art that several alternative embodiments of the work stations illustrated in FIGS. 10A-10D are possible. Although not shown, other embodiments of the invention include configurations wherein each one of the work stations 1000, 1010, 1020, and 1030 are removably attached to one or more spine walls, wing panels, return panels, etc. In one such embodiment, one side surface of the paneling system is removably attached to a spine wall and the other side surface is attached to a return panel. Alternatively, one and/or both side surfaces of the paneling system are removably attached to one or more return panel, wing panel, spine wall, post, etc.

Various modifications to the exemplary embodiments presented hereinabove are possible without departing from the spirit, scope, and intent of the disclosure. All such variations are considered as being with the bounds of the instant invention.

We claim:

1. A paneling system, comprising:

a frame having a top and a bottom surface, and a first and a second side surface;

a first attachment assembly removably securing a first post to the first side surface; and a second attachment assembly removably securing a second post to the second side surface;

wherein the bottom surface comprises a beltline tube; and wherein the beltline tube includes at least one attachment channel.

2. The paneling system of claim 1, wherein the at least one attachment channel removably engages at least one work surface bracket.

3. The paneling system of claim 2, wherein the at least one work surface bracket fixedly secures at least one work surface.

4. A paneling system, comprising:

a frame having a top and a bottom surface, and a first and a second side surface;

a first attachment assembly removably securing a first post to the first side surface; and a second attachment assembly removably securing a second post to the second side surface;

wherein the first post is an end post extending from a plane of the top surface and beyond a plane of the bottom surface, wherein the second post is an end post extending from a plane of the top surface and beyond a plane of the bottom surface, wherein the top surface comprises a topcap, wherein the bottom surface comprises a beltline tube, and wherein the beltline tube includes at least one attachment channel.

5. The paneling system of claim 4, wherein the at least one attachment channel removably engages at least one work surface bracket.

6. The paneling system of claim 5, wherein the at least one work surface bracket fixedly secures at least one work surface.

7. The paneling system of claim 6, wherein each of the first and the second attachment assembly comprises:

at least two spaced apart shoulder bolts on each of the first and the second post;

at least two spaced apart key-hole slots on each of the first and the second side surface of the frame, wherein the key-hole slots are aligned for mating with and engaging the shoulder bolts;

at least one engagement clip on each of the first and the second side surface of the frame; and at least one engagement slot on each of the first and the second post, wherein the engagement slot is aligned for mating with and engaging the engagement clip.

8. The paneling system of claim 7, wherein the frame is a workspace divider.

9. The paneling system of claim 7, wherein the first attachment assembly removably secures the frame to a spine wall.

10. The paneling system of claim 7, wherein the first attachment assembly is configured for slidably engaging the frame and the spine wall.

11. The paneling system of claim 6, wherein each of the first and the second attachment assembly comprises:

at least two spaced apart shoulder bolts on each of the first and the second side surface of the frame;

at least two spaced apart key-hole slots on each of the first and the second post, wherein the key-hole slots are aligned for mating with and engaging the shoulder bolts;

at least one engagement clip on each of the first and the second post; and at least one engagement slot on each of the first and the second side surface of the frame, wherein the engagement slot is aligned for mating with and engaging the engagement clip.

12. A paneling system, comprising:

a first frame having a first top and a first bottom surface, and a first and a second side surface;

a first attachment assembly removably securing a first post to the first side surface;

a second attachment assembly removably securing a second post to the second side surface;

a second frame having a second top and a second bottom surface, and a third and a fourth side surface;

a third attachment assembly removably securing a third post to the third side surface;

a fourth attachment assembly removably securing a fourth post to the fourth side surface;

a fifth attachment assembly removably engaging the second top surface to the second post; and a sixth attachment assembly removably engaging the second bottom surface to the second post.

13. The paneling system of claim 12, wherein:

each of the first, the second, the third and the fourth attachment assembly comprises:

at least two spaced apart shoulder bolts on each of the first, the second, the third and the fourth post;

at least two spaced apart key-hole slots on each of the first, the second, the third and the fourth side surface, wherein the key-hole slots are aligned for mating with and engaging the shoulder bolts;

at least one engagement clip on each of the first, the second, the third and the fourth side surface; and at least one engagement slot on each of the first, the second, the third and the fourth post, wherein the engagement slot is aligned for mating with and engaging the engagement clip;

the fifth attachment assembly comprises a top bracket fixedly secured to the second post and removably engaged to the second top surface; and the sixth attachment assembly comprises a bottom bracket fixedly secured to the second post and removably engaged to the second bottom surface.

14. The paneling system of claim 12, wherein:

each of the first, the second, the third and the fourth attachment assembly comprises:

at least two spaced apart shoulder bolts on each of the first, the second, the third and the fourth side surface;

at least two spaced apart key-hole slots on each of the first, the second, the third and the fourth post, wherein the key-hole slots are aligned for mating with and engaging the shoulder bolts;

at least one engagement clip on each of the first, the second, the third and the fourth post; and at least one engagement slot on each of the first, the second, the third and the fourth side surface, wherein the engagement slot is aligned for mating with and engaging the engagement clip;

the fifth attachment assembly comprises a top bracket fixedly secured to the second post and removably engaged to the second top surface; and the sixth attachment assembly comprises a bottom bracket fixedly secured to the second post and removably engaged to the second bottom surface.

15. The paneling system of claim 12, wherein the first and the second bottom surfaces respectively comprise a first and a second beltline tube.

16. The paneling system of claim 15, wherein each of the first and the second beltline tube includes at least one attachment channel.

17. The paneling system of claim 16, wherein the at least one attachment channel in the first beltline tube removably engages at least one work surface bracket.

18. The paneling system of claim 17, wherein:

the at least one work surface bracket fixedly secures at least one work surface; and the at least one bottom bracket fixedly secured to the second post removably engages the at least one attachment channel in the second beltline tube.

19. The paneling system of claim 12, wherein the frame is a workspace divider.

20. The paneling system of claim 12, wherein the first post is a connector on a spine wall.

21. The paneling system of claim 12, wherein the first attachment assembly removably secures the first frame to a spine wall.

22. The paneling system of claim 12, wherein the first attachment assembly is configured for slidably engaging the first frame and a spine wall.

23. The paneling system of claim 12, wherein the second attachment assembly is configured for slidably engaging the first frame and the second frame.

24. The paneling system of claim 12, wherein at least the second top surface is a topcap comprising at least one groove for removably engaging the at least one top bracket fixedly secured to the second post.

25. The paneling system of claim 12, wherein the first and the second bottom surfaces respectively comprise a first and a second beltline tube.

26. The paneling system of claim 25, wherein each of the first and the second beltline tube includes at least one attachment channel.

27. The paneling system of claim 26, wherein the at least one attachment channel in the first beltline tube removably engages at least one work surface bracket.

28. The paneling system of claim 27, wherein:

the at least one work surface bracket fixedly secures at least one work surface; and the at least one bottom bracket fixedly secured to the second post removably engages the at least one attachment channel in the second beltline tube.

29. The paneling system of claim 28, wherein the first post is a connector on a spine wall.

30. The paneling system of claim 12, wherein at least the second top surface is a topcap comprising at least one groove for removably engaging the at least one top bracket fixedly secured to the second post.

31. The paneling system of claim 30, wherein the first and the second bottom surfaces respectively comprise a first and a second beltline tube.

32. The paneling system of claim 31, wherein each of the first and the second beltline tube includes at least one attachment channel.

33. The paneling system of claim 32, wherein the at least one attachment channel in the first beltline tube removably engages at least one work surface bracket.

34. The paneling system of claim 33, wherein:

the at least one work surface bracket fixedly secures at least one work surface; and the at least one bottom bracket fixedly secured to the second post removably engages the at least one attachment channel in the second beltline tube.

35. The paneling system of claim 34, wherein:

each of the first, the second, the third and the fourth attachment assembly comprises:

at least two spaced apart shoulder bolts on each of the first, the second, the third and the fourth post;

at least two spaced apart key-hole slots on each of the first, the second, the third and the fourth side surface, wherein the key-hole slots are aligned for mating with and engaging the shoulder bolts;

at least one engagement clip on each of the first, the second, the third and the fourth side surface; and at least one engagement slot on each of the first, the second, the third and the fourth post, wherein the engagement slot is aligned for mating with and engaging the engagement clip;

the fifth attachment assembly comprises a top bracket fixedly secured to the second post and removably engaged to the second top surface; and the sixth attachment assembly comprises a bottom bracket fixedly secured to the second post and removably engaged to the second bottom surface.

36. The paneling system of claim 35, wherein the first frame is a workspace divider.

37. The paneling system of claim 35, wherein the first attachment assembly removably secures the first frame to a spine wall.

38. The paneling system of claim 35, wherein the first attachment assembly is configured for slidably engaging the first frame and the spine wall.

39. The paneling system of claim 38, wherein the second attachment assembly is configured for slidably engaging the first frame and the second frame.

40. The paneling system of claim 34, wherein:

each of the first, the second, the third and the fourth attachment assembly comprises:

at least two spaced apart shoulder bolts on each of the first, the second, the third and the fourth side surface;

at least two spaced apart key-hole slots on each of the first, the second, the third and the fourth post, wherein the key-hole slots are aligned for mating with and engaging the shoulder bolts;

at least one engagement clip on each of the first, the second, the third and the fourth post; and at least one engagement slot on each of the first, the second, the third and the fourth side surface, wherein the engagement slot is aligned for mating with and engaging the engagement clip;

the fifth attachment assembly comprises a top bracket fixedly secured to the second post and removably engaged to the second top surface; and the sixth attachment assembly comprises a bottom bracket fixedly secured to the second post and removably engaged to the second bottom surface.

* * * * *